US009693604B2

(12) United States Patent
Cin et al.

(10) Patent No.: US 9,693,604 B2
(45) Date of Patent: Jul. 4, 2017

(54) ARTICLE OF FOOTWEAR WITH INNER AND OUTER MIDSOLE LAYERS

(71) Applicant: NIKE, Inc., Beaverton, OR (US)

(72) Inventors: David Jonathan Cin, Portland, OR (US); Drew Conant, Lake Oswego, OR (US); Anthony P. Daversa, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/601,318

(22) Filed: Jan. 21, 2015

(65) Prior Publication Data

US 2015/0342300 A1 Dec. 3, 2015

Related U.S. Application Data

(60) Provisional application No. 62/005,230, filed on May 30, 2014.

(51) Int. Cl.

| | |
|---|---|
| ***A43B 17/00*** | (2006.01) |
| ***A43B 13/12*** | (2006.01) |
| ***A43B 13/14*** | (2006.01) |
| ***A43B 13/18*** | (2006.01) |

(52) U.S. Cl.

CPC ..... *A43B 17/003* (2013.01); *A43B 13/125* (2013.01); *A43B 13/14* (2013.01); *A43B 13/188* (2013.01)

(58) Field of Classification Search

CPC ..... A43B 13/386; A43B 13/187; A43B 13/42; A43B 13/04; A43B 13/12; A43B 13/125; A43B 13/127; A43B 13/38; A43B 13/41; A43B 17/003; A43B 17/14; A43B 17/18; A43B 513/127; A43B 13/16; A43B 5/025; A43B 23/0625; A43B 5/002; A43B 5/003; A43B 17/10; A43B 17/08; A43B 5/005; A43B 23/0265; A43B 13/14; A43B 13/188

USPC ..... 36/103, 88, 102, 25 R, 43, 133, 91, 96, 36/59 R

See application file for complete search history.

(56) References Cited

U.S. PATENT DOCUMENTS

| | | | | |
|---|---|---|---|---|
| 4,614,046 A * | 9/1986 | Dassler | A43B 5/06 36/30 R |
| 4,947,560 A * | 8/1990 | Fuerst | A43B 23/08 36/114 |
| 5,134,791 A | 8/1992 | Gregory | |

(Continued)

FOREIGN PATENT DOCUMENTS

| | | |
|---|---|---|
| EP | 1205121 A1 | 5/2002 |
| EP | 1632337 A2 | 3/2006 |

*Primary Examiner* — Anna Kinsaul
*Assistant Examiner* — Heather Mangine
(74) *Attorney, Agent, or Firm* — Quinn IP Law

(57) ABSTRACT

An article of footwear includes an outsole having a heel region, a midfoot region, and a forefoot region. An outer midsole layer is secured to the outsole and extends only over the heel region and at least some of the midfoot region. An inner midsole layer is supported by the outer midsole layer and the outsole without being fixed thereto, and extends over the heel region, the midfoot region, and the forefoot region. The outer midsole layer is configured to surround a periphery of the inner midsole layer at the heel region. The outsole may include lateral and medial arch portions for traction.

36 Claims, 12 Drawing Sheets

(56) References Cited

U.S. PATENT DOCUMENTS

| | | | | |
|---|---|---|---|---|
| 5,799,413 | A * | 9/1998 | Argyris | A43B 7/00 36/141 |
| D424,793 | S | 5/2000 | Lubart | |
| 6,523,282 | B1 * | 2/2003 | Johnston | A43B 5/02 36/133 |
| D509,347 | S | 9/2005 | Horton | |
| 7,287,343 | B2 | 10/2007 | Healy | |
| 7,730,640 | B2 | 6/2010 | Clark et al. | |
| 8,296,973 | B2 | 10/2012 | Roberti | |
| D677,453 | S | 3/2013 | Sakai | |
| 8,549,772 | B2 | 10/2013 | Crain | |
| 2003/0093920 | A1 * | 5/2003 | Greene | A43B 7/141 36/25 R |
| 2008/0216360 | A1 | 9/2008 | Schenone | |
| 2009/0113757 | A1 * | 5/2009 | Banik | A43B 7/144 36/28 |
| 2011/0072690 | A1 | 3/2011 | Teteriatnikov et al. | |
| 2011/0225852 | A1 | 9/2011 | Mahoney | |
| 2011/0258879 | A1 * | 10/2011 | Dananberg | A43B 7/141 36/91 |
| 2011/0258883 | A1 * | 10/2011 | Eder | A43B 5/02 36/133 |
| 2012/0167417 | A1 | 7/2012 | McDowell et al. | |
| 2012/0198728 | A1 * | 8/2012 | Farrelly | A43B 3/0063 36/25 R |

* cited by examiner

ARTICLE OF FOOTWEAR WITH INNER AND OUTER MIDSOLE LAYERS

CROSS-REFERENCE TO RELATED APPLICATION

This application claims the benefit of U.S. Provisional Application No. 62/005,230 filed May 30, 2014, which is hereby incorporated by reference in its entirety.

TECHNICAL FIELD

The present disclosure relates to a sole assembly for an article of footwear.

BACKGROUND

Footwear typically includes a sole configured to be located under a wearer's foot to space the foot away from the ground or floor surface. Soles can be designed to provide a desired level of cushioning. Athletic footwear in particular sometimes utilizes polyurethane foam, rubber, or other resilient materials in the sole to provide cushioning.

DETAILED DESCRIPTION

Figure 1:
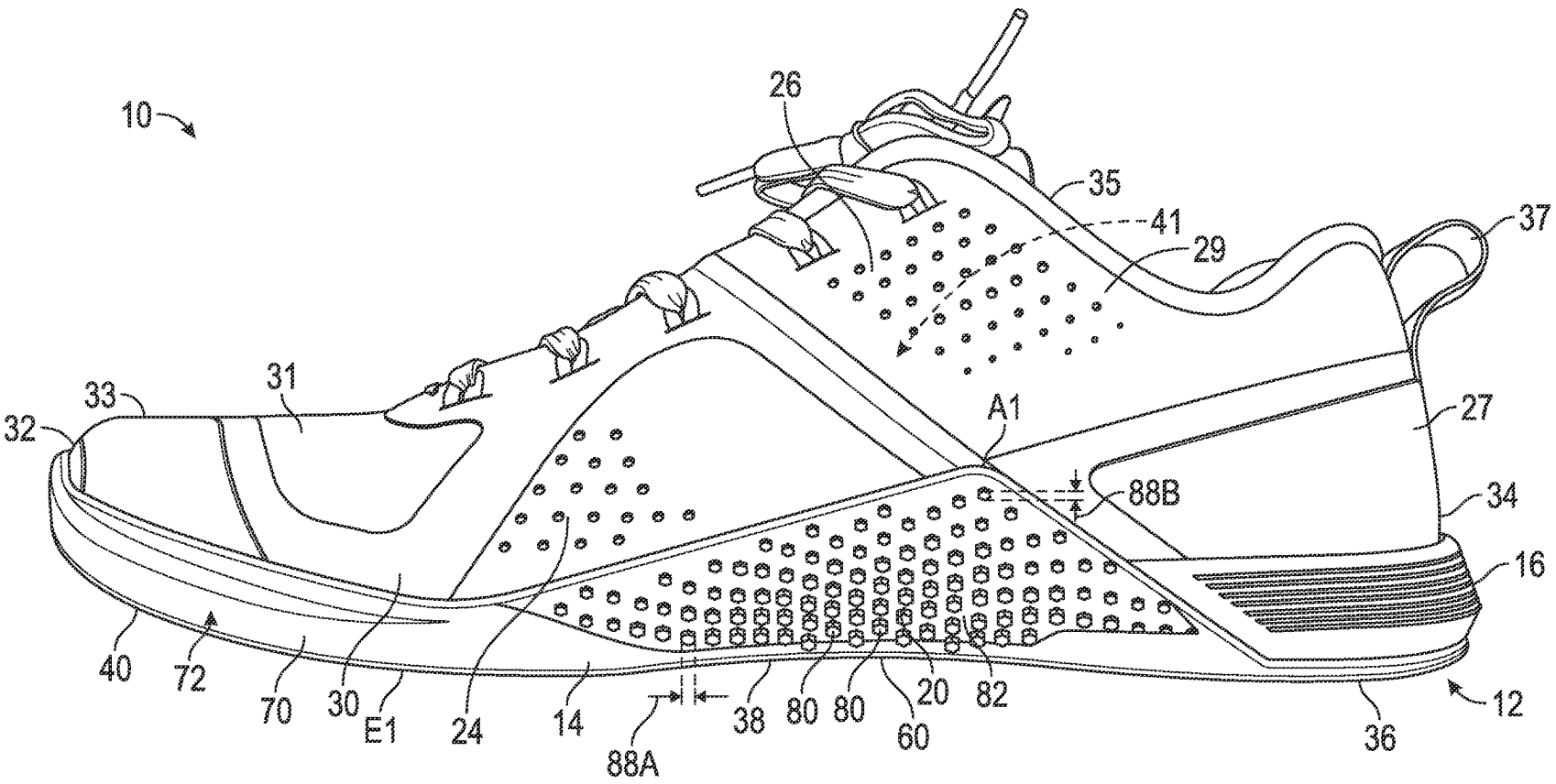
FIG. 1 is a schematic illustration in side view of a medial side of an article of footwear.

An article of footwear is disclosed that includes a variety of features making it suitable for use in different activities, including athletic activities, such as but not limited to running, rope climbing, and weightlifting. The article of footwear includes an outsole having a heel region, a midfoot region, and a forefoot region. An outer midsole layer is secured to the outsole and extends only over the heel region and at least some of the midfoot region. An inner midsole layer is supported by the outer midsole layer and the outsole without being fixed thereto, and extends over the heel region, the midfoot region, and the forefoot region. Because the inner midsole layer is supported by the outer midsole layer and the outsole, but is not adhered or otherwise secured to any component of the article of footwear, the inner midsole layer provides desired cushioning and compliance without any undesired rigidity. The outer midsole layer is configured to surround a periphery of the inner midsole layer at the heel region, thus bounding laterally outward deformation of the inner midsole during use.

A strobel unit may be secured to the outer midsole layer and to the outsole such that the outer midsole layer is between the strobel unit and the outsole at the heel region, and the strobel unit is secured directly to the outsole at the forefoot region. The article of footwear may include a shoe upper that has a perimeter surrounded by and secured to the outsole and the outer midsole layer to define a cavity, with the midsole-layer selectively insertable into and removable from the cavity.

The article of footwear may also include a bottom portion defining a ground contact surface, a medial arch portion extending from the bottom portion on a medial side of the bottom portion, and a lateral arch portion extending from the bottom portion on a lateral side of the bottom portion. The medial arch portion and the lateral arch portion may each be generally triangular, or may be another shape. The outsole may have a plurality of spaced protrusions extending outward from the medial arch portion and from the lateral arch portion. The spaced protrusions may decrease in effective diameter in a direction away from the bottom portion. The spaced protrusions may extend further outward from the medial arch portion than from the lateral arch portion. The longer protrusions on the medial arch portion will provide a greater coefficient of friction when the medial side of the article of footwear is used for activities such as rope climbing, while the shorter protrusions on the lateral side will have a lower coefficient of friction, such as may be desired when the lateral arch portion is used during descent. Additionally, the spaced protrusions may be configured such that they decrease in effective diameter in a direction away from the bottom portion. In other words, the spaced protrusions are longest closest to a bottom portion of the outsole where the maximum grip during climbing is desired.

The midsole layers are cooperatively configured to provide desirable performance benefits. For example, the outer midsole layer may be harder than the inner midsole layer. The outer midsole layer and the inner midsole layer may be ethylene vinyl acetate foam. In one embodiment, the outer midsole layer is at least seven points harder than the inner midsole layer on a Durometer Shore A scale. The inner midsole layer may have a substantially uniform hardness. As used herein, a component has a "substantially uniform" hardness if the hardness throughout the entire component does not vary by more than 10 percent. The harder outer midsole layer that surrounds the perimeter of the inner midsole layer in the heel portion provides stability and support, while the softer inner midsole layer provides a cushioned feel.

The inner midsole layer may have grooves extending over the forefoot region of the outsole. The grooves may be in a surface that contacts the strobel unit in the forefoot region. At least some of the grooves may extend transversely from a medial side to a lateral side of the inner midsole layer. One of the grooves may extend longitudinally and intersect at least some of the grooves that extend transversely. The grooves may increase compliance and flexibility in the forefoot region. Additionally, the inner midsole layer may have spaced recesses that extend over the forefoot region of the outsole.

The outsole has a bottom portion that establishes a ground contact surface. The bottom portion may have a first portion with a first hardness and a second portion with a second hardness greater than the first hardness. The first portion extends over only some of the forefoot region and the second portion surrounds the first portion and extends over a remainder of the outsole. The softer first portion increases traction in the forefoot region.

The outsole may also have a medial sidewall portion and a lateral sidewall portion. The bottom portion extends from the medial sidewall portion to the lateral sidewall portion and defines an edge with the medial sidewall portion and another edge with the lateral sidewall portion. The medial sidewall portion may have a first side surface extending substantially perpendicular to the ground contact surface of the bottom portion, and the lateral sidewall portion may have a second side surface extending substantially perpendicular to the ground contact surface of the bottom portion. The sidewall portions with first and second side surfaces extending substantially perpendicular to the ground contact surface lend stability to the article of footwear, such as to prevent undesired lateral movement during weightlifting or the like.

In one embodiment, an article of footwear includes a unitary outsole having a bottom portion with a heel region, a midfoot region, and a forefoot region and defining a ground contact surface. The outsole has a medial arch portion and a lateral arch portion extending from the bottom portion. An outer midsole layer is secured to the outsole and extends only over the heel region and at least some of the midfoot region. A strobel unit is secured to the outer midsole layer and to the outsole such that the outer midsole layer is between the strobel unit and the outsole at the heel region, and the strobel unit is secured directly to the outsole at the forefoot region. A shoe upper is secured to the strobel unit to define a cavity, and is surrounded along a perimeter by the outsole and the outer midsole layer. An inner midsole layer is in the cavity and is supported on the strobel unit without securement to any of the strobel unit, the outsole, the outer midsole layer and the shoe upper. The inner midsole layer extends over the heel region, the midfoot region, and the forefoot region. The outer midsole layer is configured to surround a periphery of the inner midsole layer at the heel region. The medial arch portion extends along the upper on a medial side of the upper, and the lateral arch portion extends along the upper on a lateral side of the upper.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items.

Those having ordinary skill in the art will recognize that terms such as "above," "below," "upward," "downward," "top," "bottom," etc., are used descriptively relative to the figures, and do not represent limitations on the scope of the invention, as defined by the claims.

The above features and advantages and other features and advantages of the present disclosure are readily apparent from the following detailed description of modes for carrying out the concepts of the disclosure when taken in connection with the accompanying drawings.

Figure 2:
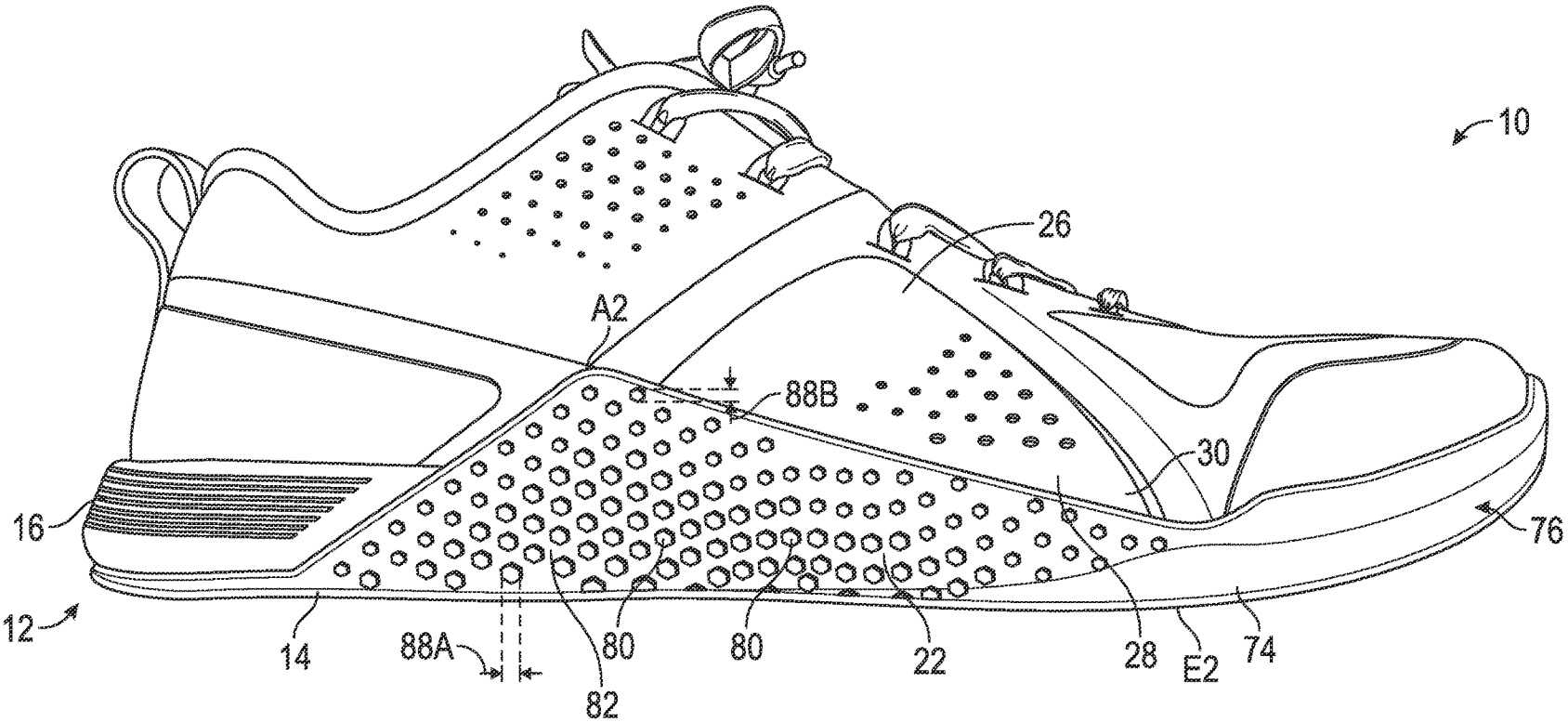
FIG. 2 is a schematic illustration in side view of a lateral side of the article of footwear of FIG. 1.
Figure 3:
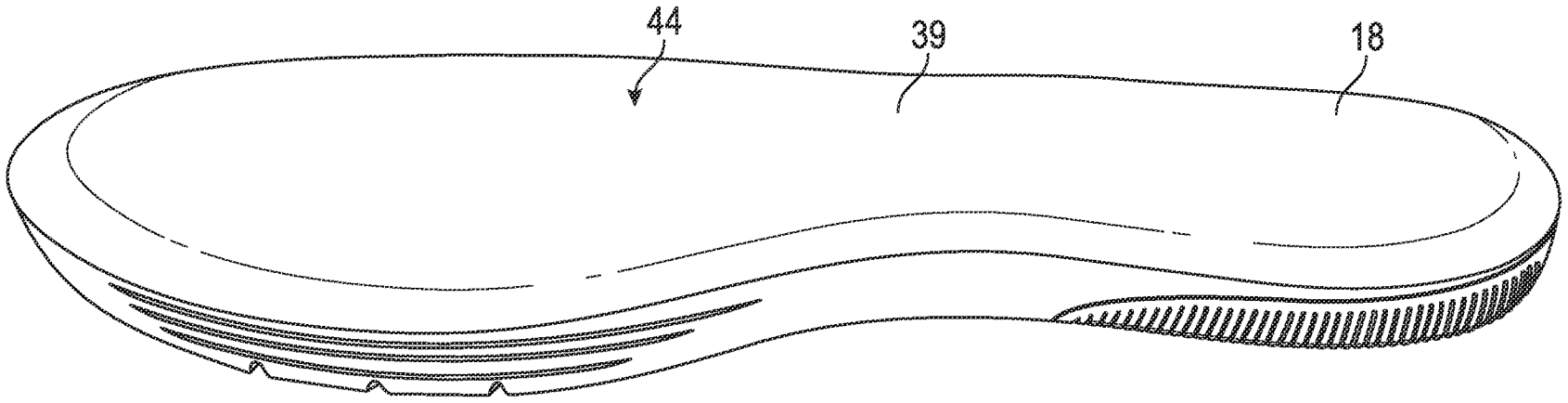
FIG. 3 is a schematic illustration in perspective view of an inner midsole layer of the article of footwear of FIG. 1.

Referring to the drawings, wherein like reference numbers refer to like components throughout the several views, FIG. 1 is a medial side view of an article of footwear 10 that includes a sole assembly 12 with an outsole 14, an outer midsole layer 16, and an inner midsole layer 18 (shown in FIG. 3). As further disclosed herein, the inner midsole layer 18 is not adhered or otherwise secured to any component of the article of footwear 10, thereby preventing undesirable rigidity. The inner midsole layer 18 is not as hard as the outer midsole layer 16 to enhance cushioning for running or other activities, while at the same time the outer midsole layer 16 and the outsole 14 provide stability for activities such as weightlifting. Moreover, the outsole 14 includes medial and lateral arch portions 20, 22 shown in FIGS. 1 and 2 that extend upward along and are secured to a medial side 24 of a footwear upper 26 and to a lateral side 28 of the upper 26 at a perimeter 30 of the upper 26 to provide traction for activities such as rope climbing.

As used herein, a lateral side of a component for an article of footwear, such as a lateral side 28 of the upper 26, is a side that corresponds with the side of the foot of the wearer of the article of footwear 10 that is generally further from the other foot of the wearer (i.e., the side closer to the fifth toe of the wearer). The fifth toe is commonly referred to as the little toe. A medial side of a component for an article of footwear, such as a medial side 24 of the article of footwear 10, is the side that corresponds with an inside area of the foot of the wearer and is generally closer to the other foot of the wearer (i.e., the side closer to the hallux of the foot of the wearer). The hallux is commonly referred to as the big toe. The lateral side 28 and the medial side 24 both extend from the foremost extent 32 of the upper 26 to the rearmost extent 34 of the upper 26.

Figure 9:
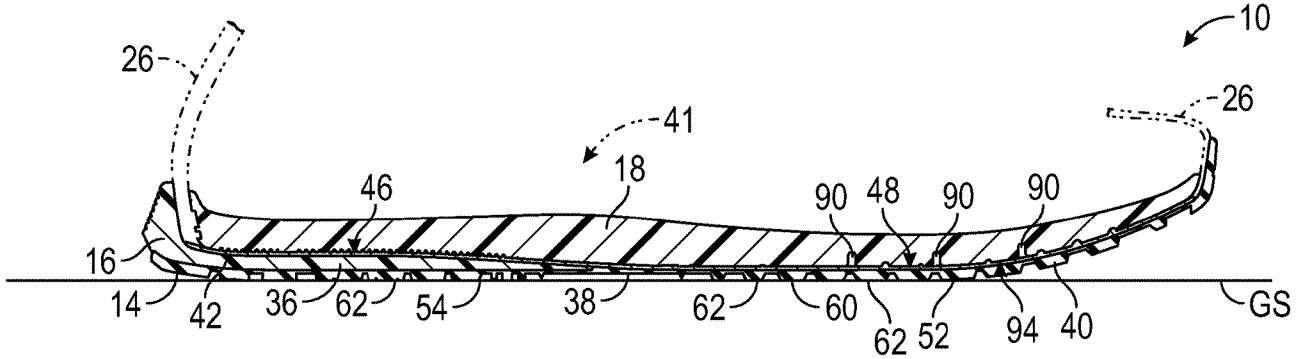
FIG. 9 is a schematic cross-sectional illustration of the sole assembly of FIG. 4 taken at lines 9-9, and showing a strobel unit and the footwear upper in fragmentary phantom view.
Figure 10:
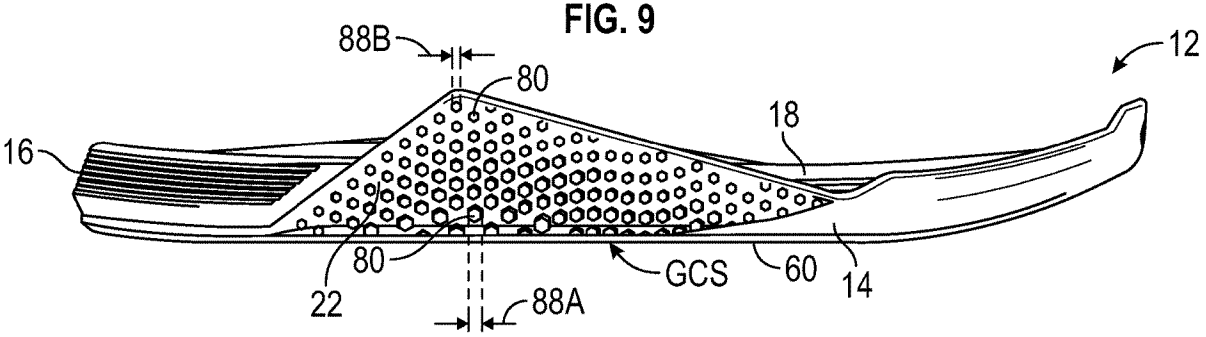
FIG. 10 is a schematic illustration in side view of the lateral side of the sole assembly of FIG. 4.
Figure 11:
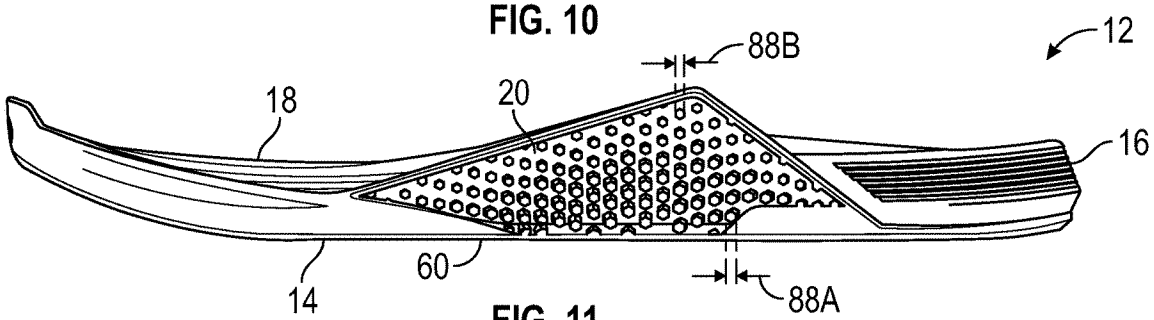
FIG. 11 is a schematic illustration in side view of the medial side of the sole assembly of FIG. 4.
Figure 12:
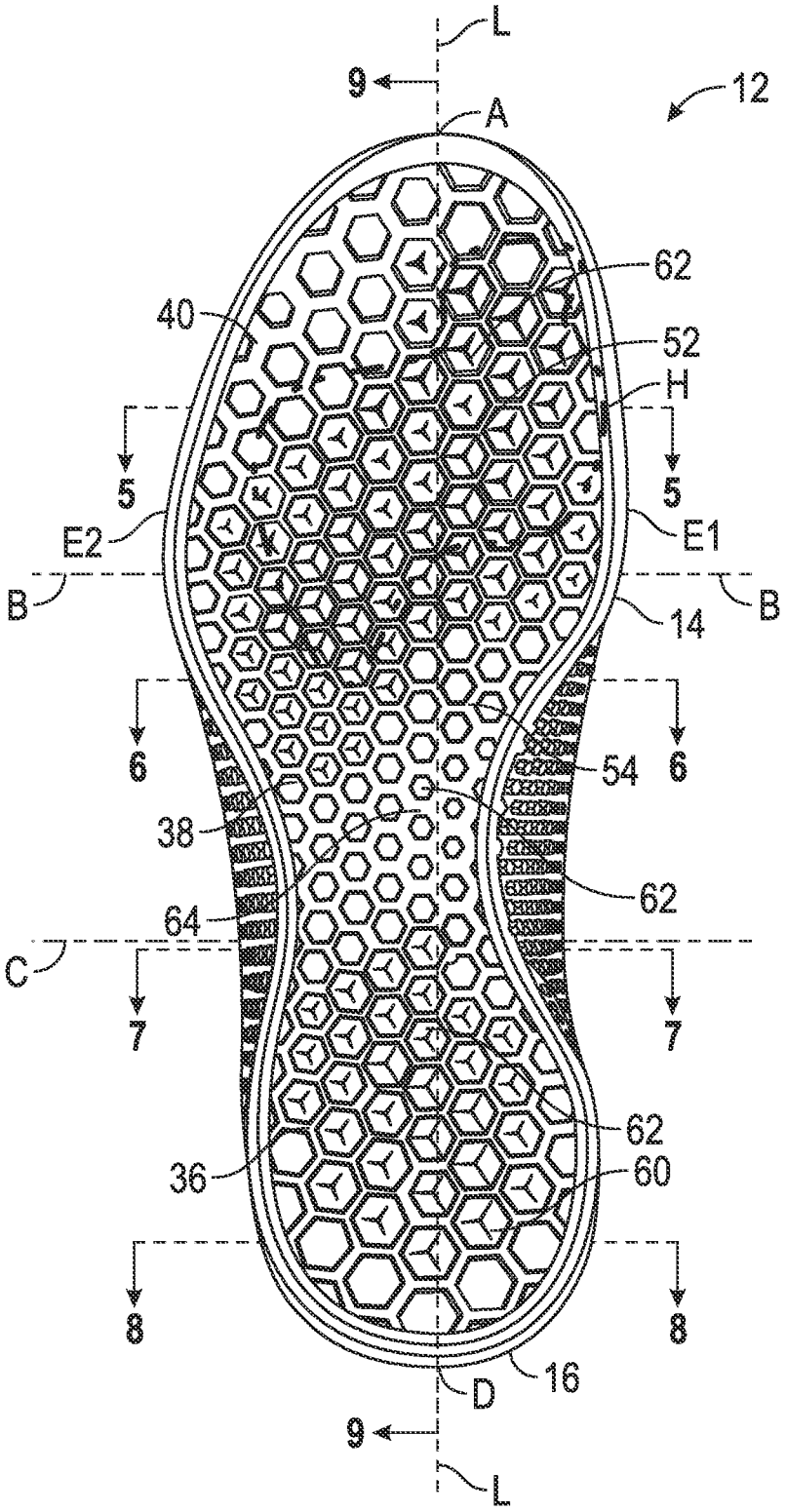
FIG. 12 is a schematic illustration in bottom view of the sole assembly of FIG. 4 and showing a phantom line separating portions of the outsole having different hardnesses.

As best shown in FIGS. 1, 9, and 12, the outsole 14 has a heel region 36, a midfoot region 38, and a forefoot region 40. The midfoot region 38 is between the heel region 36 and the forefoot region 40. For purposes of discussion, the heel region 36, the midfoot region 38, and the forefoot region 40 are respectively defined as the rearmost third, the middle third, and the foremost third of the outsole 14. Accordingly, the forefoot region 40 extends from a foremost extent A of the outsole 14 to lateral marker B, which is spaced one-third of the way from the foremost extent A to the rearmost extent D of the outsole 14 along a longitudinal axis L. The midfoot region 38 extends from lateral marker B to lateral marker C, which is spaced two-thirds of the way from the foremost extent A to the rearmost extent D along the longitudinal axis L. The heel region extends from the lateral marker C to the rearmost extent D.

The heel region 36 generally includes portions of the outsole 14 corresponding with rear portions of a human foot including the calcaneus bone and of a size corresponding with the outsole 14 and article of footwear 10. Forefoot region 40 generally includes portions of the outsole 14 corresponding with the toes and the joints connecting the metatarsals with the phalanges of the human foot of the size corresponding with the outsole 14 and article of footwear 10. Midfoot region 38 generally includes portions of the outsole 14 corresponding with an arch area of the human foot of the size corresponding with the outsole 14 and article of footwear 10.

FIG. 9 shows that the outer midsole layer 16 is secured to the outsole 14 and extends only over the heel region 36 and a portion of the midfoot region 38. The inner midsole layer 18 is supported by the outer midsole layer 16 and the outsole 14 but is not fixed thereto. In other words, the inner midsole layer 18 is not adhered, sewn, bonded, welded, or otherwise secured to any other component of the article of footwear 10. Instead, the inner midsole layer 18 simply rests on a strobel unit 42 within a cavity 41 defined and bounded by the upper 26 and the strobel unit 42. The strobel unit 42 is stitched to the upper 26. Alternatively, heat seaming, bonding, or other methods of securing the footwear upper 26 to the strobel unit 42 can be used. The strobel unit 42 is also adhered or bonded directly to an upward-facing surface 46 of the outer midsole layer 16 at the heel region 36, to a portion of the midfoot region 38 not covered by the outer midsole layer 16, and directly to an upward-facing surface 48 of the outsole 14 at the forefoot region 40. The upper 26 can be comprised of multiple separate pieces and materials such as fabric, textiles, leather, plastics, etc. With reference to FIG. 1, in the embodiment shown, the upper 26 includes a relatively stiff polymer heel counter 27, a leather portion 29, a fabric mesh portion 31, a polymer toe cap 33, a cloth lining 35, and a nylon pull strap 37.

Figure 4:
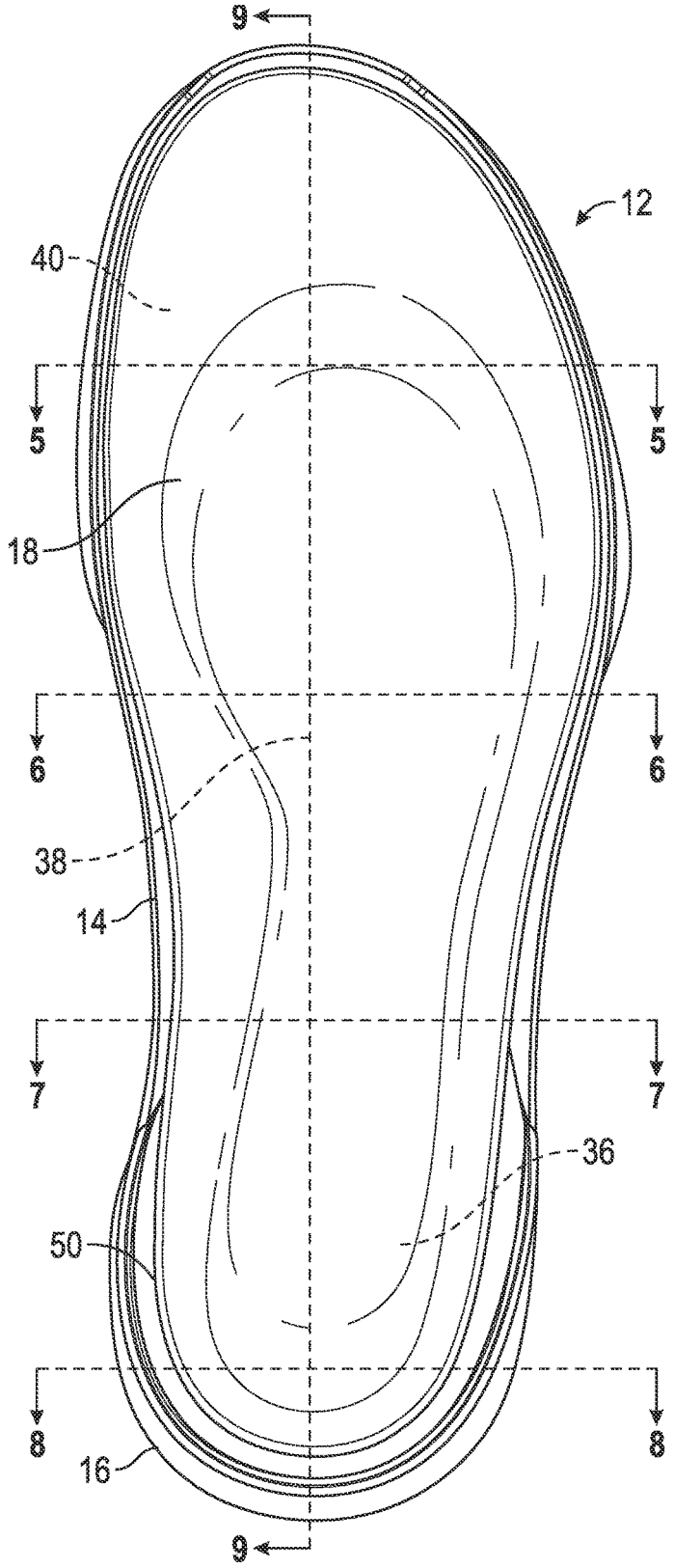
FIG. 4 is a schematic illustration in plan view of a sole assembly of the article of footwear of FIG. 1 with a footwear upper not shown.
Figure 8:
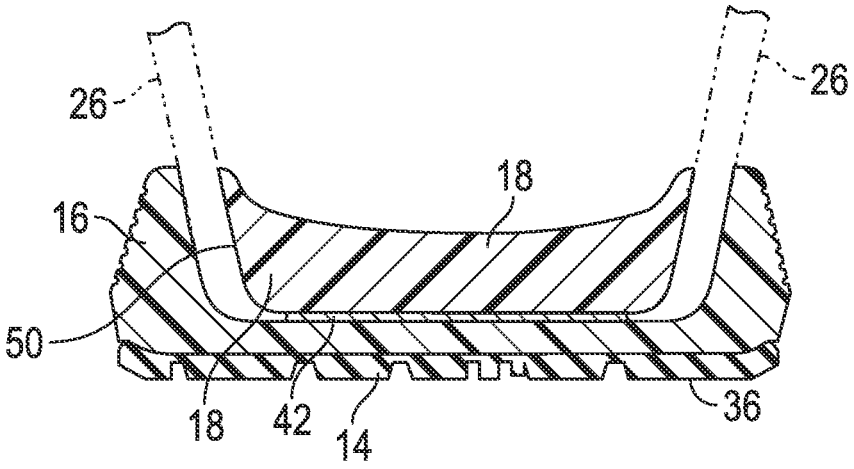
FIG. 8 is a schematic cross-sectional illustration of the sole assembly of FIG. 4 taken at lines 8-8, and showing a strobel unit and the footwear upper in fragmentary phantom view.

As shown in FIGS. 3 and 9, the inner midsole layer 18 is a full-length midsole layer, such that it extends over the heel region 36, the midfoot region 38, and the forefoot region 40 when placed in the cavity 41. The inner midsole-layer 18 can thus be selectively inserted or removed from the cavity 41, and is referred to as a drop-in midsole. Because the inner midsole layer 18 is not secured to any component of the article of footwear 10, it may exhibit some minimal relative movement with respect to the strobel unit 42, the outer midsole layer 16 and the outsole 14 under some load forces. This reduces rigidity, and produces a flexible feel during wear. However, the inner midsole layer 18 is supported by outer midsole layer 16 and the outsole 14, and is relatively confined by the outer midsole layer 16 and the upper 26. For example, as best shown in FIGS. 4 and 8, the outer midsole layer 16 is configured to surround a periphery 50 of the inner midsole layer 18 at the heel region 36.

As further discussed herein, the outer midsole layer 16 is harder than the inner midsole layer 18. For example, in one embodiment, the outer midsole layer 16 is seven points harder than the inner midsole layer 18 when hardness is measured on a Durometer Shore A scale. Both the inner midsole layer 18 and the outer midsole layer 16 can be a polymeric foam, such as ethylene vinyl acetate (EVA) foam. The inner midsole layer 18 can be a lighter weight, less dense foam than the outer midsole layer 16. The inner midsole layer 18 is configured with a substantially uniform hardness that provides appropriate cushioning and compliance under the heel of a wearer, while the surrounding outer midsole layer 16 is harder to provide lateral support, resiliency, and energy absorption at the heel region 36. As shown in FIG. 3, the inner midsole layer 18 has a fabric liner 39 secured to a foot-receiving surface 44, i.e., an upper surface.

The outsole 14, on the other hand, is not of a uniform hardness. Specifically, FIG. 12 shows a boundary H that generally separates first portion 52 of the outsole from a second portion 54 of the outsole 14. The first portion 52 extends over only some of the forefoot region 40 and coincides generally with a pressure-bearing region under the ball of a wearer's foot. The second portion 54 includes an entire remainder of the outsole 14. The first portion 52 has a first hardness, and the second portion 54 has a second hardness greater than the first hardness. The first portion 52 is softer than the second portion 54, and has a greater coefficient of friction with respect to a ground surface GS, shown in FIG. 9, than does the harder rubber of the second portion 54. The first portion 52 is thus both more compliant and provides greater traction with respect to forces conveyed from the ball of a wearer's foot through the forefoot region 40, such as during lateral movement and/or climbing. The outsole 14 may be a thermoplastic rubber or other durable material. The material for the outsole 14 may be selected to provide a desirable combination of durability and flexibility.

Figure 13:
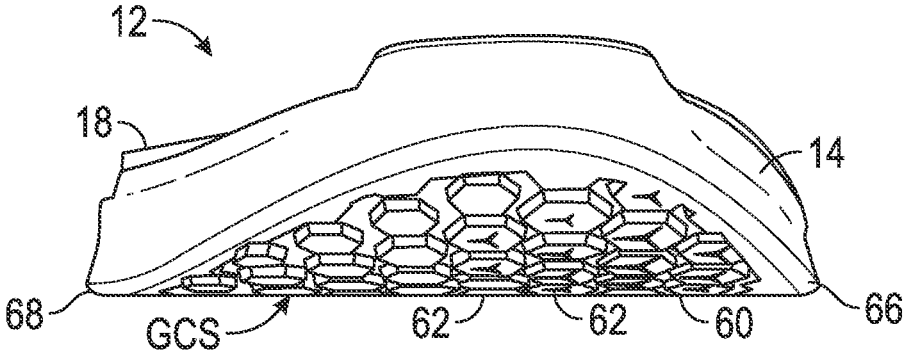
FIG. 13 is a schematic illustration in front view of the sole assembly of FIG. 4.
Figure 14:
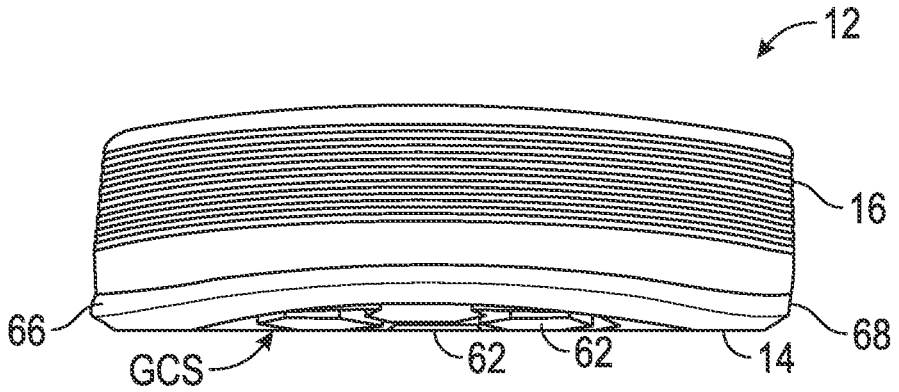
FIG. 14 is a schematic illustration in rear view of the sole assembly of FIG. 4.

With reference to FIGS. 9-12, the outsole 14 has a bottom portion 60 that defines a ground contact surface GCS. The ground contact surface GCS includes those portions of the bottom portion 60 that are configured to be in contact with the ground surface GS of FIG. 9 when the article of footwear 10 is worn for most activities in which the wearer is generally upright, such as running or weightlifting. As is evident in FIGS. 9 and 12, the bottom portion 60 has a plurality of molded tread elements 62 of various sizes, most or all of which have a hexagonal shape. Other shapes of tread elements may be used within the scope of the present disclosure. The tread elements 62 extend outward from a base 64 of the outsole 14. Accordingly, those ones of the tread elements 62 in contact with the ground surface GS establish the ground contact surface GS. As is shown in FIGS. 10, 11, 13, and 14, the tread elements 62 are configured so that the ground contact surface GCS of the outsole 14 is generally flat from a medial side 66 of the outsole 14 to a lateral side 68 of the outsole 14 when the article of footwear 10 is placed upright as shown and is not being worn, i.e., when the outsole 14 is unloaded, or when the outsole 14 is bearing the weight of a person wearing the article of footwear 10 and standing upright. As indicated in FIGS. 9, 13 and 14, not all of the tread elements 62 are likely to be in contact with the ground contact surface GCS at once, and different portions of the outsole 14 will be in contact with the ground as the wearer's foot moves relative to the ground.

Figure 5:
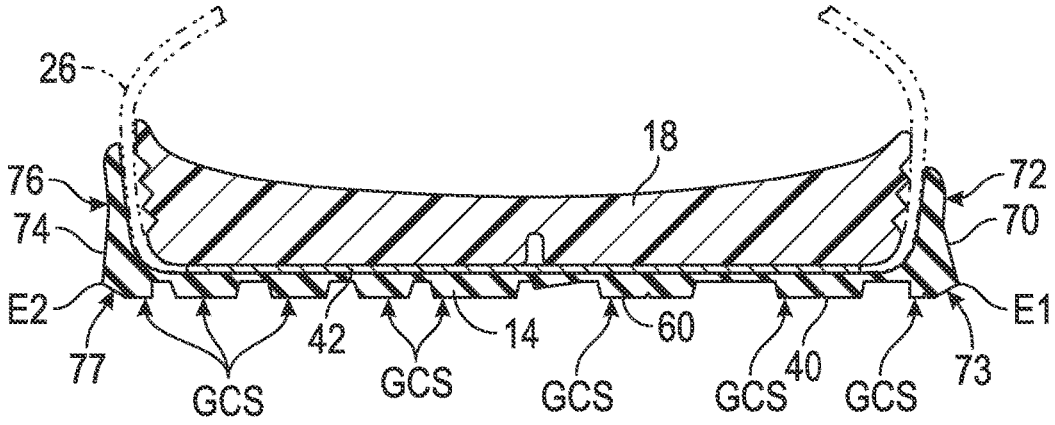
FIG. 5 is a schematic cross-sectional illustration of the sole assembly of FIG. 4 taken at lines 5-5, and showing a footwear upper in fragmentary phantom view.
Figure 6:
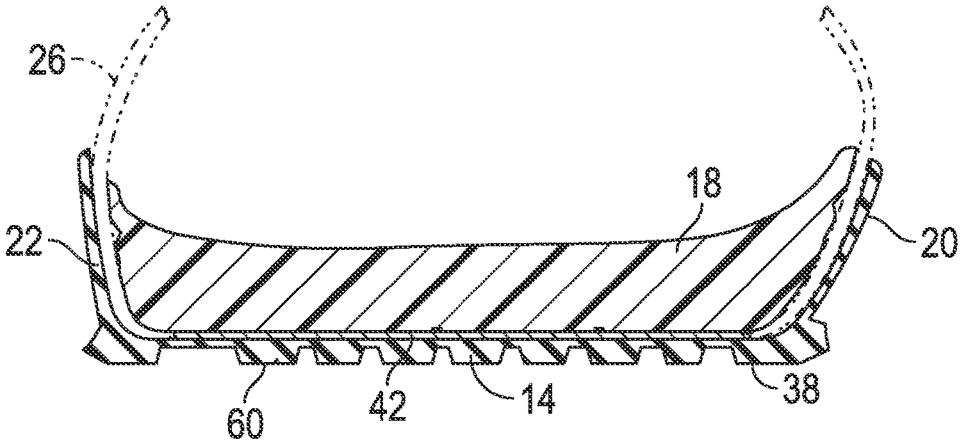
FIG. 6 is a schematic cross-sectional illustration of the sole assembly of FIG. 4 taken at lines 6-6, and showing a footwear upper in fragmentary phantom view.

The substantial flatness of the ground contact surface GCS from the medial side 66 to the lateral side 68 at any given location along the longitudinal axis L of the outsole 14 contributes to the stability of the article of footwear 10. Specifically, the article of footwear 10 is relatively difficult to roll laterally given the substantial width and flatness of the bottom portion 60. Additionally, as shown in FIG. 5, the outsole 14 has a medial sidewall portion 70 with a first side surface 72 that extends substantially perpendicularly to the bottom ground contact surface GCS. The outsole 14 also has a lateral sidewall portion 74 with a second side surface 76 that extends substantially perpendicularly to the bottom contact surface GCS. The medial sidewall portion 70 and the lateral sidewall portion 74 are adjacent the forefoot region 40 of the outsole 14. An edge E1 is defined by and between the bottom portion 60 and the medial side wall portion 70 at an angled surface 73, similar to a chamfer, and an edge E2 is defined by and between the bottom portion 60 and the lateral sidewall portion 74 at an angled surface 77, similar to a chamfer, as also shown in FIG. 12. By providing angled surfaces 73, 77 with edges E1, E2 rather than a more rounded transition from the bottom portion 60 to the sidewall portions 70, 74, the stability and resistance to lateral roll of the outsole 14 is increased.

FIGS. 1, 2, 6-7, 10-12 show the medial arch portion 20 extending from the bottom portion 60 on the medial side 24 of the bottom portion 60, and the lateral arch portion 22 extending from the bottom portion 60 on a lateral side 26 of the bottom portion 60. The medial arch portion 20 and lateral arch portion 22 are generally triangular in shape, and extend approximately half-way up the sides of the upper 26 to an apex A1, A2, respectively.

Figure 7:
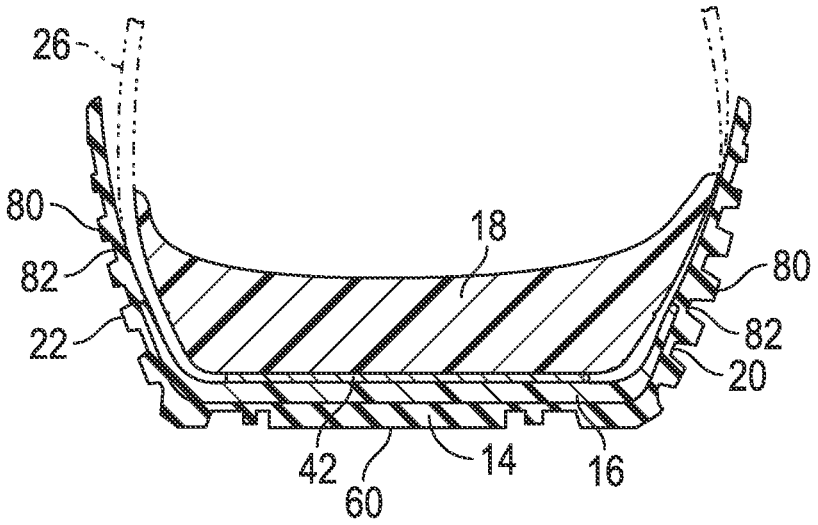
FIG. 7 is a schematic cross-sectional illustration of the sole assembly of FIG. 4 taken at lines 7-7, and showing a strobel unit and the footwear upper in fragmentary phantom view.
Figure 20:
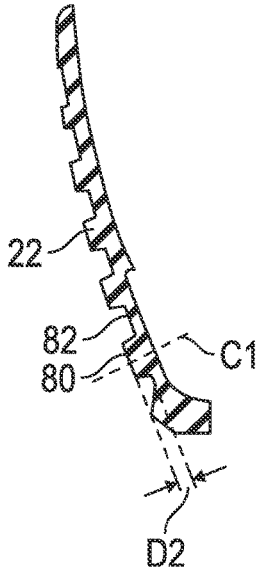
FIG. 20 is a schematic illustration in fragmentary cross-sectional view of the lateral arch portion of the outsole.
Figure 21:
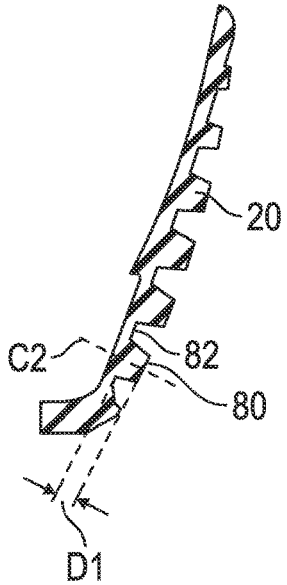
FIG. 21 is a schematic illustration in fragmentary cross-sectional view of the medial arch portion of the outsole.

A plurality of spaced protrusions 80 extend outward from a base 82 of the outsole 14 at the medial arch portion 20 and at the lateral arch portion 22, as shown in FIGS. 1 and 2. Like the tread elements 62, the protrusions 80 are hexagonal in shape, but other shapes may be used. In fact, the protrusions 80 serve as tread elements for the medial arch portion 20 and the lateral arch portion 22, such as when the article of footwear 10 is used for rope climbing. During rope climbing, the medial arch portion 20 is generally pressed against a rope and used for traction during ascent. During descent, the climber may reposition his foot so that the lateral arch portion 22 is in contact with the rope. Generally, greater traction is desired when ascending, than when descending. During descent, a skilled rope climber may desire contact between the rope and the lateral arch portion 22, but may wish to use the lateral arch portion 22 for sliding support against the rope to increase the speed of descent. Accordingly, a greater coefficient of friction is desired at the medial arch portion 20 than at the lateral arch portion 22. To accommodate these needs, the spaced protrusions 80 extend further outward from the base 82 on the medial arch portion 20 than on the lateral arch portion 22. FIG. 21 shows the lateral and medial arch portions of FIG. 7 in larger view. FIGS. 7 and 20 show that the longest spaced protrusions 80 on the medial arch portion 20 extend a distance D1 from the base 82, while FIG. 20 shows that the longest spaced protrusions 80 on the lateral arch portion 22 extend a lesser distance D2 from the base 82. The distances D1, D2 outward from the base 82 are measured along a respective center axis C1, C2 of the protrusion 80.

It is also apparent in FIGS. 1, 2, and 7 that the spaced protrusions 80 on either of the medial arch portion 20 or the lateral arch portion 22 extend further outward near the bottom portion 60, and decrease in outward extension in a direction further away from the bottom portion 60 (i.e., protrusions 80 closer to the apex A1 or A2 extend outward less than those protrusions 80 closer to the bottom portion 60). In addition to decreasing in length of extension, the spaced protrusions 80 also decrease in effective diameter in a direction away from the bottom portion 60. In other words, protrusions 80 closer to the apex A1 or A2 have a smaller effective diameter than those protrusions 80 closer to the bottom portion 60. FIGS. 1 and 2 show a protrusion close to the bottom portion 60 having an effective diameter 88A, while a protrusion closer to the apex A1 or A2 has a smaller effective diameter 88B. As used herein, the effective diameter of the hexagonal protrusion 80 is the diameter of a circular protrusion having an equivalent surface area as the hexagonal face of the protrusion.

Figure 15:
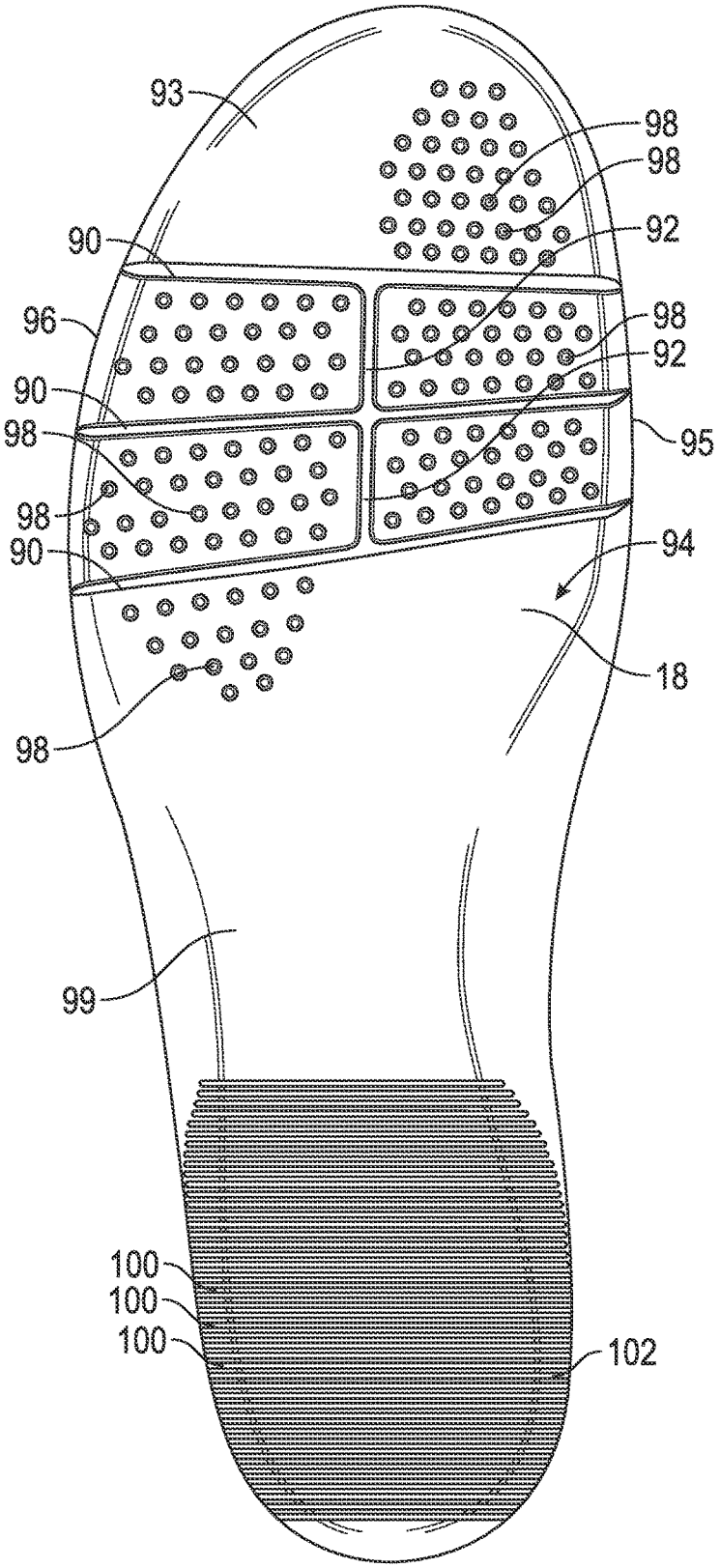
FIG. 15 is a schematic illustration in bottom view of an inner midsole layer of the sole assembly of FIG. 4.
Figure 16:
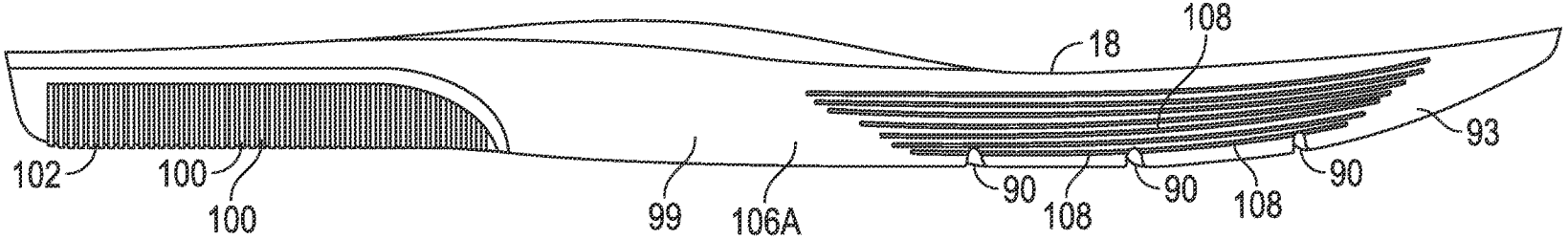
FIG. 16 is a schematic illustration in side view of a lateral side of the inner midsole layer of FIG. 15.

With reference to FIG. 15, the inner midsole layer 18 is formed with grooves 90, 92 in a forefoot portion 93 of the inner midsole layer 18. The grooves 90, 92 extend over the forefoot region 40 of the outsole 14 when the inner midsole layer 18 is placed in the cavity 41 of the article of footwear 10. The grooves 90, 92 are in a bottom surface 94 of the inner midsole layer 18 that contacts the strobel unit 42 in the forefoot region 40. The grooves 90 are transverse grooves as they extend transversely from a medial side 95 to a lateral side 96 of the inner midsole layer 18. Groove 92 is a longitudinal groove as it extends longitudinally and intersects at least some of the transverse grooves 92. The grooves 90, 92 increase compliance and flexibility of the inner midsole layer 18 in the forefoot region 40.

FIG. 15 also shows that the bottom surface 94 of the inner midsole layer 18 that contacts the strobel unit 42 has spaced recesses 98, only some of which are labeled with reference numbers. The spaced recesses 98 are in the bottom surface 94 of the inner midsole layer 18 that contacts the strobel unit 42 in the forefoot region 40, and therefore extend over the forefoot region 40 of the outsole 14 when the inner midsole layer 18 is placed in the cavity 41. The spaced recesses 98 increase compliance of the material of the inner midsole layer 18 in the forefoot region 40. Additionally, the spaced recesses 98 increase the coefficient of friction of the inner midsole layer 18 on the strobel unit 42 relative to a relatively smooth midfoot portion 99 of the inner midsole layer 18. The increased coefficient of friction in the forefoot region 93 helps to limit sliding movement of the inner midsole layer 18 relative to the strobel unit 42. The pattern of the spaced recesses 98 in FIG. 15 generally coincides with the first portion 52 of the outsole 14 (shown in FIG. 12) that has softer rubber than the second portion 54. The grooves 90, 92, spaced recesses 98, and first portion 52 thus all align in the forefoot region 40 to increase compliance, flexibility, and cushioning in the forefoot region 40 of the article of footwear 10.

FIG. 15 shows that the inner midsole layer 18 also has transverse grooves 100 in a heel portion 102 of the inner midsole layer 18. The grooves 100 are generally shallower than the grooves 90. The grooves 100 help to increase the compliance and coefficient of friction of the inner midsole layer 18 in the heel region 102 relative to a relatively smooth midfoot portion 99 of the inner midsole layer 18. The increased coefficient of friction in the heel region 102 helps to limit sliding movement of the inner midsole layer 18 relative to the strobel unit 42 when the inner midsole layer 18 is placed in the cavity 41.

Figure 17:
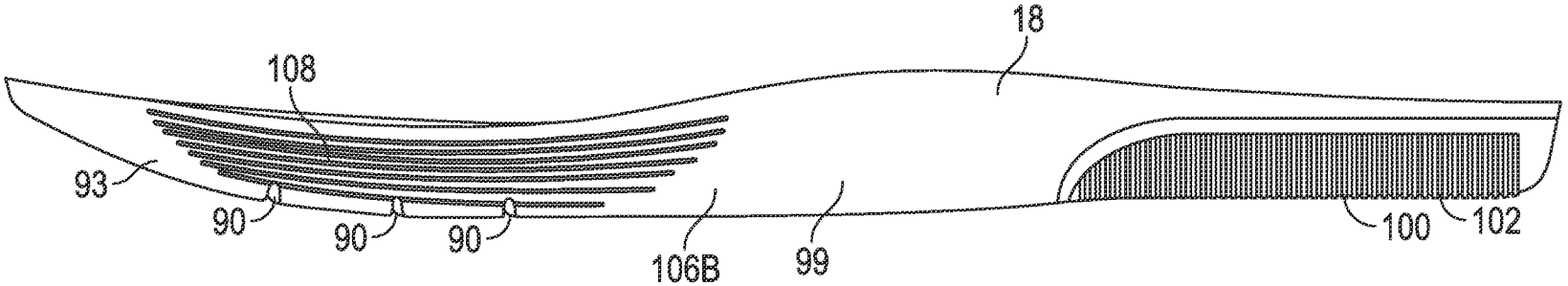
FIG. 17 is a schematic illustration in side view of a medial side of the inner midsole layer of FIG. 15.
Figure 18:
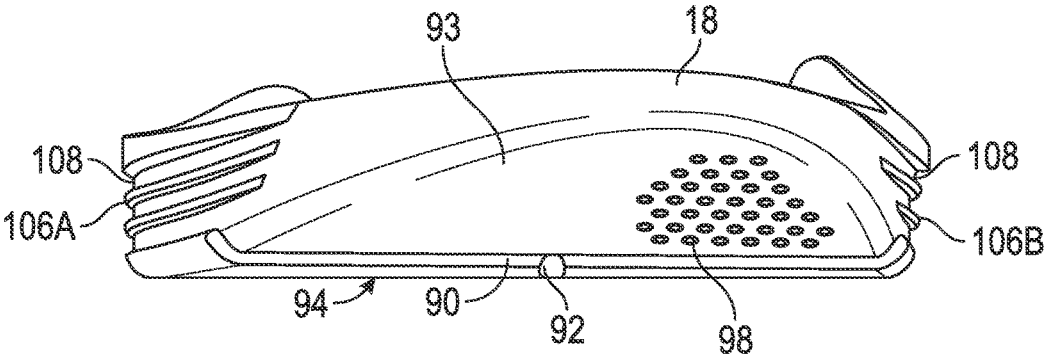
FIG. 18 is a schematic illustration in front view of the inner midsole layer of FIG. 15.
Figure 19:
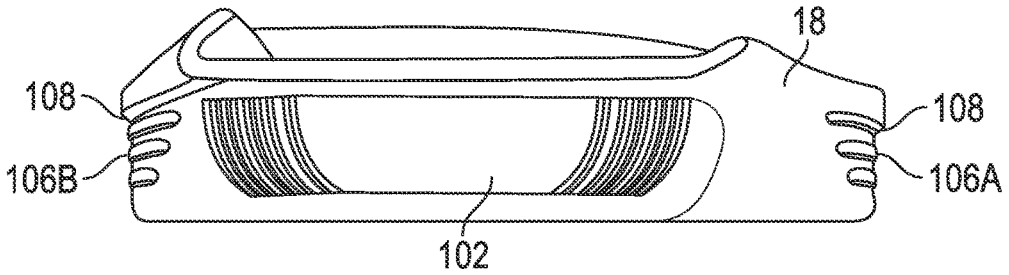
FIG. 19 is a schematic illustration in rear view of the inner midsole layer of FIG. 15.

FIGS. 16-19 show that the inner midsole layer 18 has lateral and medial sidewall portions 106A, 106B both of which have longitudinally extending pleats 108 generally in the forefoot portion 93 and extending partway into the midfoot portion 99 as indicated in FIG. 17. The pleats 108 may also be referred to alternating ridges and valleys. The pleats 108 increase compliance of the forefoot portion 93 of the inner midsole layer 18. It is apparent in FIGS. 16 and 17 that the treads 100 of the heel portion 102 continue from the bottom surface 94 of the inner midsole layer 18 to the sidewall portions 106A, 106B.

While several modes for carrying out the many aspects of the present teachings have been described in detail, those familiar with the art to which these teachings relate will recognize various alternative aspects for practicing the present teachings that are within the scope of the appended claims.

The invention claimed is:

1. An article of footwear comprising:

an upper;

a unitary, one-piece outsole having:

a heel region, a midfoot region, and a forefoot region;

a bottom portion defining a ground contact surface and extending entirely over the heel region, the midfoot region, and the forefoot region;

a medial arch portion in the midfoot region;

a lateral arch portion in the midfoot region;

an outer midsole layer secured to the outsole and extending only over the heel region and at least some of the midfoot region; and an inner midsole layer supported by the outer midsole layer and the outsole without being fixed thereto;

wherein:

the inner midsole layer extends over the heel region, the midfoot region, and the forefoot region;

the outer midsole layer is configured to surround a periphery of the inner midsole layer at the heel region;

the medial arch portion extends upward from a medial side of the bottom portion outward of the outer midsole layer and the inner midsole layer onto a medial side of the upper;

the lateral arch portion extends upward from a lateral side of the bottom portion outward of the outer midsole layer and the inner midsole layer onto a lateral side of the upper;

at least one of the medial arch portion or the lateral arch portion has a rear edge, a front edge, and an apex between the rear edge and the front edge;

the rear edge angles forward from the bottom portion to the apex, and the front edge angles rearward from the bottom portion to the apex;

the outsole has sidewall portions extending upward from the bottom portion and secured to sides of the upper at a forefoot portion of the upper so that only the upper and the outsole are exposed at the forefoot region;

the medial arch portion and the lateral arch portion extend to the sidewall portions so that the outer midsole layer is only exposed at the heel region;

the outsole has a plurality of spaced protrusions extending outward from the medial arch portion and from the lateral arch portion; and the spaced protrusions are each of the same shape and decrease in effective diameter in a direction away from the bottom portion uniformly across the medial arch portion and the lateral arch portion such that the spaced protrusions closest to the bottom portion have a greater effective diameter than the spaced protrusions furthest from the bottom portion.

2. The article of footwear of claim 1, wherein the shoe upper has a perimeter surrounded by and secured to the outsole and the outer midsole layer to define a cavity from which the inner midsole layer is selectively insertable and removable.

3. The article of footwear of claim 1, wherein the spaced protrusions extending from the medial arch portion extend further outward than the spaced protrusions extending from the lateral arch portion.

4. The article of footwear of claim 1, wherein the medial arch portion and the lateral arch portion are each generally triangular.

5. The article of footwear of claim 1, wherein the outer midsole layer is harder than the inner midsole layer on a Durometer Shore A scale.

6. The article of footwear of claim 1, wherein the outer midsole layer is at least seven points harder than the inner midsole layer on a Durometer Shore A scale.

7. The article of footwear of claim 1, wherein the inner midsole layer is of a substantially uniform hardness.

8. The article of footwear of claim 1, wherein the inner midsole layer has grooves extending over the forefoot region of the outsole.

9. The article of footwear of claim 8, wherein at least some of the grooves extend transversely from a medial side to a lateral side of the inner midsole layer.

10. The article of footwear of claim 9, wherein one of the grooves extends longitudinally and intersects at least some of the grooves that extend transversely.

11. The article of footwear of claim 8, wherein:

the grooves extend from a lateral side to a medial side of the inner midsole layer;

the inner midsole layer has spaced recesses extending over the forefoot region of the outsole between the grooves;

the spaced recesses are arranged in a pattern that has an outer periphery;

the outsole has a first portion and a second portion;

the first portion has a first hardness and the second portion has a second hardness greater than the first hardness;

the first portion has an outer periphery that coincides with the outer periphery of the pattern of the spaced recesses and extends from the medial side of the outsole; and the second portion surrounds the first portion.

12. The article of footwear of claim 1, wherein:

the outsole has a first portion and a second portion; wherein the first portion has a first hardness and the second portion has a second hardness greater than the first hardness; and wherein the first portion extends over only some of the forefoot region and the second portion surrounds the first portion and extends over a remainder of the outsole.

13. The article of footwear claim 1, wherein the sidewall portions include:

a medial sidewall portion extending upward from the medial side of the bottom portion outward of and around the inner midsole layer onto the medial side of the upper;

a lateral sidewall portion extending upward from the lateral side of the bottom portion outward of and around the inner midsole layer onto the lateral side of the upper; and the bottom portion defines an edge with the medial sidewall portion and another edge with the lateral sidewall portion.

14. The article of footwear of claim 1, wherein the sidewall portions include:

a medial sidewall portion having a first side surface extending substantially perpendicularly to the ground contact surface and upward from the medial side of the bottom portion onto the medial side of the upper; and a lateral sidewall portion having a second side surface extending substantially perpendicularly to the ground contact surface and upward from the lateral side of the bottom portion onto the lateral side of the upper.

15. The article of footwear of claim 1, further comprising:

a strobel unit secured to the outer midsole layer and to the outsole such that the outer midsole layer is between the strobel unit and the outsole at the heel region, and the strobel unit is secured directly to the outsole at the forefoot region.

16. An article of footwear comprising:

a unitary, one-piece outsole having a bottom portion with a heel region, a midfoot region, and a forefoot region and defining a ground contact surface; wherein the outsole has a medial arch portion and a lateral arch portion extending from the bottom portion;

an outer midsole layer secured to the outsole and extending only over the heel region and at least some of the midfoot region;

a strobel unit secured to the outer midsole layer and to the outsole such that the outer midsole layer is between the strobel unit and the outsole at the heel region, and the strobel unit is secured directly to the outsole at the forefoot region;

a shoe upper secured to the strobel unit to define a cavity, and surrounded along a perimeter by the outsole and the outer midsole layer;

an inner midsole layer in the cavity and supported on the strobel unit without securement to any of the strobel unit, the outsole, the outer midsole layer and the shoe upper; wherein the inner midsole layer extends over the heel region, the midfoot region, and the forefoot region;

wherein:

the outer midsole layer is configured to surround a periphery of the inner midsole layer at the heel region;

the outsole is entirely under the outer midsole layer at a rear periphery of the heel region extending from the lateral arch portion to the medial arch portion so that the outer midsole layer is exposed only in the heel region and along the entire-rear periphery of the heel region;

the medial arch portion extends upward along the upper onto a medial side of the upper, and the lateral arch portion extends upward along the upper onto a lateral side of the upper;

the outsole has sidewall portions extending upward from the bottom portion and secured to sides of the upper at a forefoot portion of the upper so that only the upper and the outsole are exposed at the forefoot region;

the medial arch portion and the lateral arch portion extend to the sidewall portions so that the outer midsole layer is only exposed at the heel region;

the outsole has a plurality of spaced protrusions extending outward from the medial arch portion and from the lateral arch portion; and the spaced protrusions are each of the same shape and decrease in effective diameter in a direction away from the bottom portion uniformly across the medial arch portion and the lateral arch portion such that the spaced protrusions closest to the bottom portion have a greater effective diameter than the spaced protrusions furthest from the bottom portion.

17. The article of footwear of claim 16, wherein the outer midsole layer and the inner midsole layer are ethylene vinyl acetate foam, and wherein the outer midsole layer is harder than the inner midsole layer on a Durometer Shore A scale.

18. The article of footwear of claim 16, wherein the outer midsole layer is at least seven points harder than the inner midsole layer on a Durometer Shore A scale.

19. The article of footwear of claim 16, wherein the inner midsole layer is of a substantially uniform hardness.

20. The article of footwear of claim 16, wherein the inner midsole layer has grooves in a surface that contacts the strobel unit in the forefoot region.

21. The article of footwear of claim 20, wherein at least some of the grooves extend transversely from a medial side to a lateral side of the inner midsole layer.

22. The article of footwear of claim 21, wherein one of the grooves extends longitudinally and intersects at least some of the grooves that extend transversely.

23. The article of footwear of claim 20, wherein the surface of the inner midsole layer that contacts the strobel unit has spaced recesses extending over the forefoot region of the outsole.

24. The article of footwear of claim 23, wherein:

the outsole has a first portion with a first hardness and a second portion with a second hardness greater than the first hardness;

the first portion extends over only some of the forefoot region and the second portion surrounds the first portion and extends over a remainder of the outsole;

the spaced recesses are arranged in a pattern that has an outer periphery; and the first portion has an outer periphery that coincides with the outer periphery of the pattern of the spaced recesses.

25. The article of footwear of claim 16, wherein the sidewall portions include:

a medial sidewall portion having a first side surface extending substantially perpendicularly to the ground contact surface at the forefoot region and upward from a medial side of the bottom portion onto the medial side of the upper; and a lateral sidewall portion having a second side surface extending substantially perpendicularly to the ground contact surface at the forefoot region and upward from a lateral side of the bottom portion onto the lateral side of the upper.

26. The article of footwear of claim 16, wherein the sidewall portions include:

a medial sidewall portion extending upward from a medial side of the bottom portion onto the medial side of the upper;

a lateral sidewall portion extending upward from a lateral side of the bottom portion onto the lateral side of the upper; and wherein the bottom portion extends from the medial sidewall portion to the lateral sidewall portion and defines an edge with the medial sidewall portion and another edge with the lateral sidewall portion.

27. The article of footwear of claim 16, wherein:

the medial arch portion and the lateral arch portion are each generally triangular;

at least one of the medial arch portion or the lateral arch portion has a rear edge, a front edge, and an apex between the rear edge and the front edge; and the rear edge angles forward from the bottom portion to the apex, and the front edge angles rearward from the bottom portion to the apex.

28. The article of footwear of claim 16, wherein the spaced protrusions extending from the medial arch portion extend further outward than the spaced protrusions extending from the lateral arch portion.

29. The article of footwear of claim 16, wherein the medial arch portion and the lateral arch portion are both in the midfoot region and both extend from the bottom portion outward of the outer midsole layer and the inner midsole layer.

30. The article of footwear of claim 16, wherein the medial arch portion and the lateral arch portion extend from the outer midsole layer that is exposed at the heel region to the outsole exposed at the forefoot region.

31. The article of footwear of claim 1, wherein the spaced protrusions decrease in length in a direction away from the bottom portion.

32. The article of footwear of claim 16, wherein the spaced protrusions are hexagonal in shape.

33. The article of footwear of claim 1, wherein the spaced protrusions furthest from the bottom portion are spaced further apart from one another than the spaced protrusions closest to the bottom portion.

34. The article of footwear of claim 1, wherein:

the inner midsole layer has grooves extending over the forefoot region of the outsole in a bottom surface of the inner midsole layer;

the inner midsole layer has spaced recesses in the bottom surface of the inner midsole layer between the grooves;

the spaced recesses are arranged in a pattern that has an outer periphery;

the outsole has a first portion and a second portion;

the first portion has a first hardness and the second portion has a second hardness greater than the first hardness;

the first portion extends from a medial side of the outsole and has an outer periphery that coincides with the outer periphery of the pattern of the spaced recesses and the first portion is directly under the grooves and the spaced recesses of the inner midsole layer; and the second portion surrounds the first portion.

35. The article of footwear of claim 1, wherein:

the outsole has tread elements on the ground contact surface of the bottom portion in the heel region, in the midfoot region, and in the forefoot region;

the spaced protrusions on the medial arch portion are tread elements; and the medial arch portion covers the inner midsole layer and the outer midsole layer in the midfoot region.

36. The article of footwear of claim 35, wherein the tread elements on two or more of the medial arch portion, the bottom portion in the heel region, the bottom portion in the midfoot region, and the bottom portion in the forefoot region have an identical shape.

* * * * *